US008836737B2

(12) United States Patent
Moriya et al.

(10) Patent No.: US 8,836,737 B2
(45) Date of Patent: Sep. 16, 2014

(54) DISPLAY DEVICE, METHOD OF DISPOSING PIXELS, AND PIXEL DISPOSITION PROGRAM

(75) Inventors: Hidekuni Moriya, Suwa (JP); Tsuyoshi Maeda, Kai (JP)

(73) Assignee: Seiko Epson Corporation, Tokyo (JP)

( * ) Notice: Subject to any disclaimer, the term of this patent is extended or adjusted under 35 U.S.C. 154(b) by 2083 days.

(21) Appl. No.: 11/470,824

(22) Filed: Sep. 7, 2006

(65) Prior Publication Data

US 2007/0085862 A1 Apr. 19, 2007

(30) Foreign Application Priority Data

Oct. 18, 2005 (JP) ..... 2005-303725
Apr. 27, 2006 (JP) ..... 2006-123391

(51) Int. Cl.
*G09G 5/02* (2006.01)
*G09G 3/36* (2006.01)
*G09G 3/20* (2006.01)

(52) U.S. Cl.
CPC ..... *G09G 3/2003* (2013.01); *G09G 3/3607* (2013.01); *G09G 2300/0452* (2013.01)
USPC ..... 345/694; 345/695; 345/55; 345/204; 345/206

(58) Field of Classification Search
CPC ..... G09G 3/3607; G09G 2300/0439
USPC ..... 345/694–695, 55, 204, 206
See application file for complete search history.

(56) References Cited

U.S. PATENT DOCUMENTS 6,366,025 B1 4/2002 Yamada
6,747,618 B2 6/2004 Arnold et al.
6,771,028 B1 8/2004 Winters
7,137,502 B2 * 11/2006 Carey et al. ..... 198/444
7,176,861 B2 2/2007 Dedene et al.

(Continued)

FOREIGN PATENT DOCUMENTS

JP A-06-324649 11/1994
JP A-08-084347 3/1996

(Continued)

OTHER PUBLICATIONS

Dictionary of Flat Panel Display Technology, edited by Tatsuo Uchida and Hiraki Uchiike, published by Kyogo Chosakai Publishing Inc., Dec. 25, 2001, p. 638 (with partial translation).

*Primary Examiner* — William Boddie
*Assistant Examiner* — Leonid Shapiro
(74) *Attorney, Agent, or Firm* — Oliff PLC

(57) ABSTRACT

A display device includes a first sub-pixel formed by a blue-type-hue colored area included in a visible light region whose hue changes in accordance with wavelength, a second sub-pixel formed by a red-type-hue colored area included in the visible light region, a third sub-pixel and a fourth sub-pixel formed by colored areas of two types of hues included in the visible light region, the two types of hues being selected from a hue range of from a blue hue to a yellow hue, and a plurality of pixels regularly disposed horizontally and vertically and each including the first to fourth sub-pixels. At least two of the four sub-pixels have different areas, and two of the four sub-pixels having smaller areas among the four sub-pixels are disposed so as not to be adjacent to each other.

16 Claims, 12 Drawing Sheets

(56) References Cited

U.S. PATENT DOCUMENTS

| | | | | |
|---|---|---|---|---|
| 7,379,080 | B2 * | 5/2008 | Asao et al. | 345/690 |
| 2005/0018110 | A1 * | 1/2005 | Liu | 349/106 |
| 2005/0168423 | A1 | 8/2005 | Hirata et al. | |
| 2007/0064020 | A1 * | 3/2007 | Credelle et al. | 345/694 |

FOREIGN PATENT DOCUMENTS

| | | | |
|---|---|---|---|
| JP | A-2001-209047 | | 8/2001 |
| JP | A-2001-296523 | | 10/2001 |
| JP | A-2002-236466 | | 8/2002 |
| JP | A-2004-079538 | | 3/2004 |
| JP | A-2004-152737 | | 5/2004 |
| JP | A-2004-272244 | | 9/2004 |
| JP | A-2004-529396 | | 9/2004 |
| JP | A-2005-515504 | | 5/2005 |
| JP | A-2005-515505 | | 5/2005 |
| JP | A-2005-208580 | | 8/2005 |
| WO | WO 02/101644 | A2 | 12/2002 |
| WO | WO 03/060869 | A1 | 7/2003 |
| WO | WO 03/060870 | A1 | 7/2003 |
| WO | WO 2007/013210 | A1 | 2/2007 |

* cited by examiner

DISPLAY DEVICE, METHOD OF DISPOSING PIXELS, AND PIXEL DISPOSITION PROGRAM

BACKGROUND

1. Technical Field

The present invention relates to a display device, a method of disposing pixels, and a pixel disposition program.

2. Related Art

One type of display device that provides a color image produces various colors by synthesizing three primary colors, red (R), green (G), and blue (B). The method of producing various desired colors in this way is called additive color mixture. Hitherto, a color liquid crystal display device that tries to display a desired white light by using a red (R) color filter, a green (G) filter, and a blue (B) color filter with the ratio between their areas being varied has been invented (refer to, for example, JP-A-8-84347).

However, since the related display device discussed in JP-A-8-84347 performs color reproduction by using three primary colors, its color reproduction area cannot be sufficiently widened as an actually manufactured display device. Moreover, JP-A-8-84347 does not consider anything about technologies for a four-color display device. When an attempt is made to simply apply the technology of varying the ratio between the areas of a red (R) pixel, green (G) pixel, and blue (B) pixel to a four-color display device, various problems arise, that is, for example, a black line appears in a vertical direction, thereby making it possible to deteriorate image quality.

SUMMARY

An advantage of the invention is that it provides a four-color display device which can provide a high-quality display, a method of disposing pixels, and a pixel disposition program.

Another advantage of the invention is that it provides a four-color display device which can reduce vertical black lines, a method of disposing pixels, and a pixel disposition program.

Still another advantage of the invention is that it provides a four-color display device which can display a desired white color and which can reduce vertical black lines, a method of disposing pixels, and a pixel disposition program.

To these ends, according to a first aspect of the invention, there is provided a display device including a first sub-pixel formed by a blue-type-hue colored area included in a visible light region whose hue changes in accordance with wavelength, a second sub-pixel formed by a red-type-hue colored area included in the visible light region, a third sub-pixel and a fourth sub-pixel formed by colored areas of two types of hues included in the visible light region, the two types of hues being selected from a hue range of from a blue hue to a yellow hue, and a plurality of pixels regularly disposed horizontally and vertically and each including the first to fourth sub-pixels. At least two of the four sub-pixels have different areas, and two of the four sub-pixels having smaller areas among the four sub-pixels are disposed so as not to be adjacent to each other.

According to the first aspect, the display device that displays a desired color by using the four sub-pixels that provide the respective four colors has a structure in which the areas of the pixels differ. Accordingly, it can display white light with high precision, and has its sub-pixels having smaller areas (that is, sub-pixels at which light-shielding portions have large areas) disposed apart from each other. Therefore, according to the first aspect, it is possible to prevent perception of vertical black lines that are produced as a result of disposing the sub-pixels having small areas adjacent to each other. Consequently, the first aspect makes it possible to achieve a display device providing a high image quality.

According to a second aspect of the invention, there is provided a display device including a first sub-pixel formed by a blue hue colored area included in a visible light region whose hue changes in accordance with wavelength, a second sub-pixel formed by a red hue colored area included in the visible light region, a third sub-pixel and a fourth sub-pixel formed by colored areas of two types of hues included in the visible light region, the two types of hues being selected from a hue range of from a blue hue to a yellow hue, and a plurality of pixels regularly disposed horizontally and vertically and each including the first to fourth sub-pixels. At least two of the four sub-pixels have different luminances, and two of the four sub-pixels having smaller luminances among the four sub-pixels are disposed so as not to be adjacent to each other.

According to the second aspect, in the display device that displays a desired color by using the four sub-pixels that provide respective four colors, the sub-pixels having lower luminances (that is, the sub-pixels at which light-shielding portions have large areas) are disposed apart from each other. Therefore, according to the second aspect, it is possible to prevent perception of vertical black lines that are produced as a result of disposing the sub-pixels having smaller luminances adjacent to each other. Consequently, the second aspect makes it possible to achieve a display device providing a high image quality. These luminances correspond to luminances of light transmitted through the colored areas of the sub-pixels. Accordingly, for example, the luminances are values obtained as a result of transmitting illumination light from an illuminator through color filters or values obtained by reflecting outside light.

It is preferable that a peak of a wavelength of light passing through the first sub-pixel lie in a range of from 415 nm to 500 nm, a peak of a wavelength of light passing through the second sub-pixel be at least 600 nm, a peak of a wavelength of light passing through the third sub-pixel lie in a range of from 485 nm to 535 nm, and a peak of a wavelength of light passing through the fourth sub-pixel lie in a range of from 500 nm to 590 nm.

It is preferable that the four sub-pixels be disposed in a straight line in one direction in each pixel, and the plurality of pixels be disposed in straight lines so that the sun-pixels of the same hue are consecutively disposed in a direction perpendicular to the one direction.

According to this form, it is possible to prevent perception of black lines resulting from the two sub-pixels having smaller areas or the two-sub-pixels having lower luminances being disposed adjacent to each other and the two sub-pixels having smaller areas (that is, pixels at which light-shielding portions have large areas) being lined up in one direction of a display plane, such as in a vertical direction. Therefore, according to this form, it is possible to provide a stripe display device providing a high image quality.

It is preferable that the display device be a mosaic display device in which the plurality of pixels are disposed in straight lines extending in one direction so that the pixels that are next to each other in a direction that is orthogonal to the one direction are displaced by at least an amount corresponding to one sub-pixel.

According to this form, it is possible to prevent perception of black lines resulting from the two sub-pixels having smaller areas or the two sub-pixels having smaller luminances being disposed adjacent to each other and the two sub-pixels having smaller areas (that is, sub-pixels at which light-shielding portions have large areas) being disposed obliquely to a display plane, such as in a vertical direction. Therefore, according to this form, it is possible to provide a mosaic display device providing a high image quality.

It is preferable that the display device be any one of a liquid crystal display device, an organic electroluminescence display device, a plasma display device, and a cathode-ray tube display device. This form is applicable to various display devices that provide colors by additive color mixture.

According to a third aspect of the invention, there is provided a method of disposing pixels of a display device that performs a displaying operation in color by using as one set a first sub-pixel, a second sub-pixel, a third sub-pixel, and a fourth sub-pixel. The first sub-pixel is formed by a blue hue colored area included in a visible light region whose hue changes in accordance with wavelength. The second sub-pixel is formed by a red hue colored area included in the visible light region. The third sub-pixel and the fourth sub-pixel are formed by colored areas of two types of hues included in the visible light region, the two types of hues being selected from a hue range of from a blue hue to a yellow hue. The method comprises evaluating a color that is produced when areas of the four sub-pixels are made the same and the displaying operation is performed using the four sub-pixels having the same area, determining the areas of the respective four sub-pixels that produce a desired white color when the areas of the four sub-pixels are made different and the displaying operation is performed using the four sub-pixels having the different areas, selecting two sub-pixels having smaller areas from among the four sub-pixels whose areas have been determined, and disposing the two selected sub-pixels so as not to be adjacent to each other.

According to the third aspect, since the area of each of the four sub-pixels forming one set is determined so as to allow display of a desired white light, it is possible to design and manufacture a display device which can display white light with high precision. In addition, according to the third aspect, since the two sub-pixels having smaller areas are disposed so as not to be adjacent to each other, it is possible to prevent the display device from being one in which vertical black lines are perceived. Therefore, according to the method of disposing pixels of the third aspect, it is possible to design and manufacture a display device providing a high image quality.

According to a fourth aspect of the invention, there is provided a method of disposing pixels of a display device that performs a displaying operation in color by using as one set a first sub-pixel, a second sub-pixel, a third sub-pixel, and a fourth sub-pixel. The first sub-pixel is formed by a blue hue colored area included in a visible light region whose hue changes in accordance with wavelength. The second sub-pixel is formed by a red hue colored area included in the visible light region. The third sub-pixel and the fourth sub-pixel are formed by colored areas of two types of hues included in the visible light region, the two types of hues being selected from a hue range of from a blue hue to a yellow hue. The method comprises evaluating a color that is produced when areas of the four sub-pixels are made the same and the displaying operation is performed using the four sub-pixels having the same area, determining luminances of the four sub-pixels and selecting two sub-pixels having smaller luminances from among the four sub-pixels, and disposing the two selected sub-pixels so as not to be adjacent to each other.

According to the fourth aspect, since the two pixels having lower luminances are disposed so as not to be adjacent to each other, it is possible to prevent a display device from being one in which vertical black lines are perceived. Therefore, according to the method of disposing pixels of the fourth aspect, it is possible to design and manufacture a display device providing a high image quality.

It is preferable that a peak of a wavelength of light passing through the first sub-pixel lie in a range of from 415 nm to 500 nm, a peak of a wavelength of light passing through the second sub-pixel be at least 600 nm, a peak of a wavelength of light passing through the third sub-pixel lie in a range of from 485 nm to 535 nm, and a peak of a wavelength of light passing through the fourth sub-pixel lie in a range of from 500 nm to 590 nm.

According to a fifth aspect of the invention, there is provided a pixel disposition program which causes operations to be executed by a computer used in manufacturing a display device that performs a displaying operation in color by using as one set a first sub-pixel, a second sub-pixel, a third sub-pixel, and a fourth sub-pixel. The first sub-pixel is formed by a blue hue colored area included in a visible light region whose hue changes in accordance with wavelength. The second sub-pixel is formed by a red hue colored area included in the visible light region. The third sub-pixel and the fourth sub-pixel are formed by colored areas of two types of hues included in the visible light region, the two types of hues being selected from a hue range of from a blue hue to a yellow hue. The operations include a white color evaluation operation (S1) for evaluating a color that is produced when areas of the four sub-pixels are made the same and the displaying operation is performed using the four sub-pixels having the same area, a white color adjustment operation (S2) for determining the areas of the respective four sub-pixels that produce a desired white color when the areas of the four sub-pixels are made different and the displaying operation is performed using the four sub-pixels having the different areas, a selection operation (S3) for selecting two sub-pixels having smaller areas from among the four sub-pixels whose areas have been determined in the white color adjustment operation, and a disposing operation (S4) for disposing the two sub-pixels selected in the selection operation so as not to be adjacent to each other.

According to a sixth aspect of the invention, there is provided a pixel disposition program which causes operations to be executed by a computer used in manufacturing a display device that performs a displaying operation in color by using as one set a first sub-pixel, a second sub-pixel, a third sub-pixel, and a fourth sub-pixel. The first sub-pixel is formed by a blue hue colored area included in a visible light region whose hue changes in accordance with wavelength. The second sub-pixel is formed by a red hue colored area included in the visible light region. The third sub-pixel and the fourth sub-pixel are formed by colored areas of two types of hues included in the visible light region, the two types of hues being selected from a hue range of from a blue hue to a yellow hue. The operations include a white color evaluation operation (S11) for evaluating a color that is produced when areas of the four sub-pixels are made the same and the four sub-pixels are made to emit light, a determination operation (S13) for determining luminances of the four sub-pixels, a selection operation (S14) for selecting two sub-pixels having smaller luminances from among the four sub-pixels, and disposing operation (S15) for disposing the two selected sub-pixels so as not to be adjacent to each other.

It is preferable that a peak of a wavelength of light passing through the first sub-pixel lie in a range of from 415 nm to 500 nm, a peak of a wavelength of light passing through the second sub-pixel be at least 600 nm, a peak of a wavelength of light passing through the third sub-pixel lie in a range of from 485 nm to 535 nm, and a peak of a wavelength of light passing through the fourth sub-pixel lie in a range of from 500 nm to 590 nm.

DESCRIPTION OF EXEMPLARY EMBODIMENTS

A display device and a method of disposing pixels according to embodiments of the invention will hereunder be described with reference to the drawings. The display device can be designed and manufactured by the method of disposing pixels according to the invention.

First Embodiment

Figure 1:
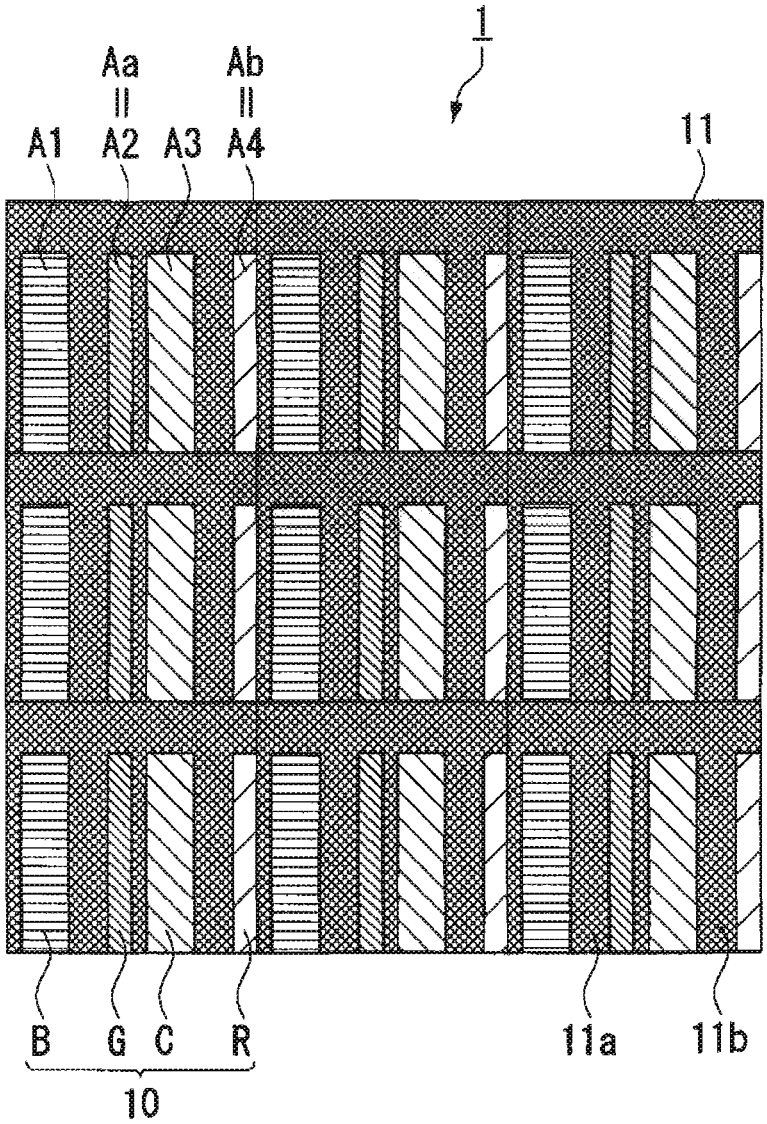
FIG. 1 is a plan view of a main portion of a display device according to a first embodiment of the invention.

FIG. 1 is a plan view of a main portion of a display device according to a first embodiment of the invention. That is, FIG. 1 shows a plane configuration of pixels in a display device 1 according to the embodiment. The display device 1 performs a color displaying operation by synthesizing four colors. More specifically, the display device 1 comprises a blue hue colored area (B; a first sub-pixel), a red hue colored area (R; a second sub-pixel), and colored areas of two types of hues (C; a third sub-pixel and D; a fourth sub-pixel) that are selected from a hue range of from a blue hue to a yellow hue. These colored areas are included in a visible light region (380 nm to 780 nm) whose hue changes with wavelength.

Here, the term "type" is used. For example, a blue-type hue is not limited to a pure-blue hue, so that it includes a blue-violet hue and a blue-green hue. A red-type hue is not limited to a red hue, so that it includes an orange hue. Each of the colored areas may comprise a single colored layer or a plurality of stacked colored layers having different hues. Each of these colored areas are defined by their hues, which are used to set colors by properly changing chroma and luminance level. These four pixels (sub-pixels) are defined as a pixel set 10. A plurality of such pixel sets 10 are regularly disposed horizontally and vertically.

The display device 1 is a stripe display device in which a plurality of pixel sets 10 are disposed on horizontal straight lines and in which the pixels are disposed on vertical straight lines so that that the pixels of the same colors are lined up vertically. Here, more specifically, the blue hue colored area (B) has a hue in the range of from a blue-violet hue to a blue-green hue, and is, desirably, in the range of from an indigo hue to a blue hue. The red hue colored area (R) has a hue in the range of from an orange to a red hue. The colored area (C) has a hue in the range of from a blue to a green hue, and, desirably, in the range of from a blue-green to a green hue. The colored area (G) has a hue in the range of from a green to an orange hue, and, desirably, in the range of from a green to a yellow hue or from a green to a yellow-green hue. There are portions where the hue ranges overlap, but the same hue is not used in the colored areas. For example, when green-type hues are used in the two colored areas whose hues are selected from the range of from a blue to a yellow hue, a blue type or a yellow-green-type hue is used in the second colored area with respect to the green hue of the first colored area. This makes it possible to achieve color reproducibility of a wide range of colors than in a related example in which a red colored area, a green colored area, and a blue colored area are used.

The colored areas have been mentioned in terms of their hues. The colored areas may have the following hue ranges if they are defined by wavelengths of light transmitted through the colored areas. The blue hue colored area (B) is a colored area in which a peak of a wavelength of light transmitted through the colored area (B) is in the range of from 415 nm to 500 nm, and, desirably, in the range of from 435 nm to 485 nm. The red hue colored area (R) is a colored area in which a peak of a wavelength of light transmitted through the colored area (R) is equal to or greater than 600 nm, and, desirably, equal to or greater than 605 nm. The colored area (C) is a colored area in which a peak of a wavelength of light transmitted through the colored area (C) is in the range of from 485 nm to 535 nm, and, desirably, in the range of from 495 nm to 520 nm. The colored area (G) is a colored area in which a peak of a wavelength of light transmitted through the colored area (G) is in the range of from 500 nm to 590 nm, and, desirably, in the range of from 510 nm to 585 nm or 530 nm to 565 nm.

These wavelengths are numerical values obtained as a result of transmitting illumination light from an illuminator through color filters when a transmissive displaying operation is performed. When a reflective displaying operation is performed, these wavelengths are numerical values obtained as a result of reflecting outside light.

The four-color colored areas are as follows when they are defined by an x, y chromaticity diagram.

The blue-type colored area (B) is a colored area in which $x \leq 0.151$ and $y \leq 0.200$, desirably, $x \leq 0.151$ and $y \leq 0.056$, and, more desirably, $0.134 \leq x \leq 0.151$ and $0.034 \leq y \leq 0.200$. Even more desirably, the blue-type colored area (B) is a colored area in which $0.134 \leq x \leq 0.151$ and $0.034 \leq y \leq 0.056$.

The red-type colored area (R) is a colored area in which $0.520 \leq x$ and $y \leq 0.360$, desirably, $0.643 \leq x$ and $y \leq 0.333$, and, more desirably, $0.550 \leq x \leq 0.690$ and $0.210 \leq y \leq 0.360$. Even more desirably, the red-type colored area (R) is a colored area in which $0.643 \leq x \leq 0.690$ and $0.299 \leq y \leq 0.333$.

One of the colored areas whose hue is selected from the hue range of from a blue hue to a yellow hue is a colored area in which $x \leq 0.200$ and $0.210 \leq y$, desirably, $x \leq 0.164$ and $0.453 \leq y$, and, more desirably, $0.080 \leq x \leq 0.200$ and $0.210 \leq y \leq 0.759$. Even more desirably, the colored area is a colored area in which $0.098 \leq x \leq 0.164$ and $0.453 \leq y \leq 0.759$.

The other colored area whose hue is selected from the hue range of from a blue hue to a yellow hue is a colored area in which $0.257 \leq x$ and $0.450 \leq y$, desirably, $0.257 \leq x$ and $0.606 \leq y$, and, more desirably, $0.257 \leq x \leq 0.520$ and $0.450 \leq y \leq 0.720$. Even more desirably, the colored area is a colored area in which $0.257 \leq x \leq 0.357$ and $0.606 \leq y \leq 0.670$.

In the x, y chromaticity diagram, numerical values are those obtained as a result of transmitting illumination light from an illuminator through the color filters when a transmissive displaying operation is performed. When a reflective displaying operation is performed, these numerical values are those obtained as a result of reflecting outside light.

A black matrix 11 is disposed as a light-shielding portion around the pixels (sub-pixels) formed by the four colored areas.

In the display device 1, the areas (opening areas) of all four pixels (sub-pixels), that is, the R pixel, the G pixel, the B pixel, and the C pixel, which define one pixel set 10, are set so that they perform a displaying operation (emit light) and produce a desired white light. Here, "desired white light" refers to, for example, a color that is set on a black body locus in a chromaticity characteristic. In FIG. 1, it is provided as follows in terms of hues. When an opening area of the pixel formed by the blue hue colored area (B) is A1, an opening area of the pixel formed by the colored area (G) and having a hue in a hue range of, for example, from a green hue to an orange hue is A2, an opening area of the pixel formed by the colored area (C) and having a hue in a hue range of, for example, from a blue hue to a green hue is A3, and an opening area of the pixel formed by the colored area (R) is A4, the opening area A2 of the pixel formed by the colored area (G) and the opening area A4 of the pixel formed by the colored area (R) are less than the opening area A1 of the pixel formed by the colored area (B) and the opening area A3 of the pixel formed by the colored area (C). In other words, A2 is less than A1 and A3, and A4 is less than A1 and A3. Any other relationships between the magnitudes of the opening areas need not be considered. Since the opening areas of the four pixels (sub-pixels) are set as mentioned above, it is possible for the one pixel set 10 to display a desired white color, so that the entire display device 1 can display the desired white color. The aforementioned relationships between the magnitudes of the opening areas are only examples. The opening areas only need to have magnitude relationships that allow one pixel set 10 to display the desired white color.

In the display device 1, two pixels Aa and Ab having smaller areas among the four pixels (sub-pixels) in the one pixel set 10 are disposed so as not to be adjacent to each other. In the embodiment shown in FIG. 1, Aa=A2 and Ab=A4, and the pixel formed by the colored area (G) having the opening area A2 and the pixel formed by the colored area (R) having the opening area A4 are disposed so as not to be adjacent to each other, that is, so as to be apart from each other. The pixel formed by the colored area (B) and the pixel formed by the colored area (C) having larger opening areas, that is, the pixels other than the two pixels Aa and Ab having smaller opening areas, may be disposed anywhere on the assumption that the aforementioned conditions are satisfied.

Here, the two pixels Aa and Ab having smaller opening areas are disposed apart from each other to prevent thick black strips 11*a* and 11*b* of the black matrix 11 from being disposed close to each other. As a result, it is possible to reduce vertical black lines in the display device 1.

Accordingly, the display device 1 of the embodiment can reduce vertical back lines, which is one factor that determines image quality, by disposing the one pixel set 10 of four pixels (sub-pixels), formed by the colored areas (R), (G), (B), and (C), as a result of fully considering the pattern formed by the four pixels and the black matrix 11. Therefore, the display device 1 according to the embodiment can enlarge the color range that it can reproduce by using four colors. In addition, the display device 1 can allow the pixels (sub-pixels) having different areas to display a desired white color with high precision, and can display a high-quality image without perceptible black lines. In addition, in general, the lower the resolving power of the display device with respect to vertical black lines, an observer tends to perceive them as large black lines. Therefore, the effect of reducing black lines becomes noticeable, the lower the resolving power of the display device 1.

Method of Disposing Pixels According to the First Embodiment

Figure 2:
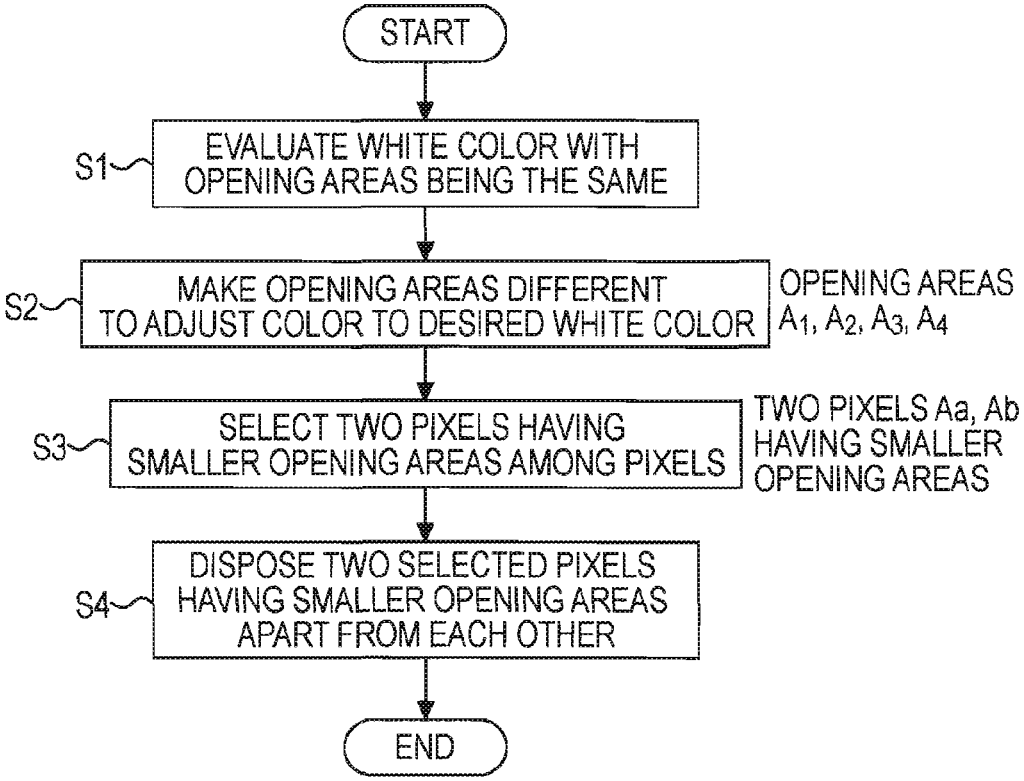
FIG. 2 is a flowchart of a method of disposing pixels according to the first embodiment of the invention.

FIG. 2 is a flowchart of a method of disposing pixels according to the first embodiment of the invention. That is, FIG. 2 is a flowchart illustrating the steps used when designing the display device 1 shown in FIG. 1. Therefore, this flowchart shows the steps that determine the disposition of the one pixel set 10 of pixels (sub-pixels) formed by the colored areas (R), (G), (B), and (C) when the opening areas of the pixels (sub-pixels) differ from each other.

First, in Step S1, a white-color evaluation operation is performed for evaluating a white color in terms of synthesized light for the four pixels (sub-pixels) having the same opening area.

The white color evaluation operation is carried out by predicting an emission spectrum characteristic from each of the four pixels (sub-pixels) having the same opening area and calculating the white color from the color characteristic of each emission spectrum. By evaluating the white color by simulation in this way, it is possible to more easily and quickly perform a desired evaluation than when, for example, a trial production is performed.

Next, in Step S2, a white color adjustment operation is performed. In the white color adjustment operation, the opening areas of the pixels (sub-pixels) are made different on the basis of a white color evaluation result in Step S1, and opening areas (A1, A2, A3, and A4) of the pixels when the synthesized light for the pixels (sub-pixels) having different opening areas becomes a desired white color are determined.

In determining the opening areas in Step S2, combinations of different opening areas of the pixels (sub-pixels) are provided, and white colors (synthesized lights) of all of the provided combinations are calculated. The combination that provides a color that is closest to the desired white color is selected from the calculated results, so that the opening areas of the pixels that provide the desired white color can be determined.

Next, in Step S3, a selection operation is performed for selecting the two pixels Aa and Ab having smaller areas among the opening areas (A1, A2, A3, and A4) of the pixels (sub-pixels) that have been determined in Step S2.

Figure 3:
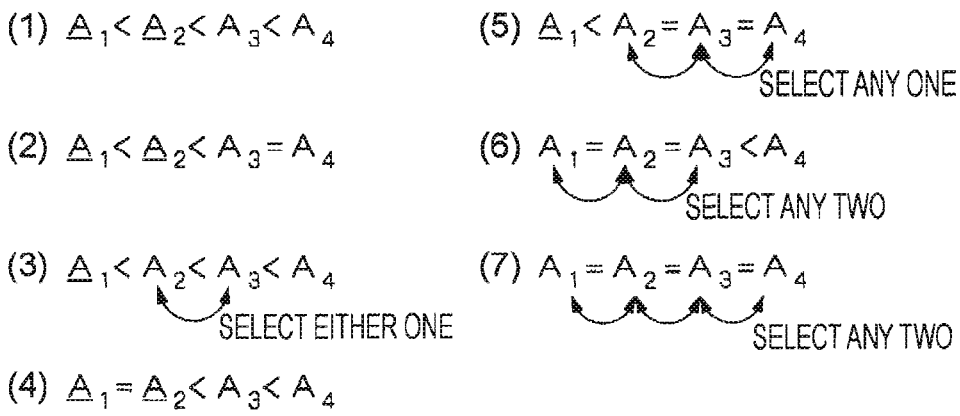
FIG. 3 illustrates a method of selecting two pixels having smaller areas in the method of disposing pixels.

FIG. 3 shows the choices that are provided when selecting the two pixels Aa and Ab having smaller areas from the pixels (sub-pixels) having the opening areas (A1, A2, A3, and A4) in Step S3. That is, FIG. 3 shows the seven choices that can be thought of as combinations of the opening areas of the pixels (sub-pixels) having different magnitude relationships. In FIG. 3, the underlined opening areas are selected as those having smaller values. For example, when there are a plurality of opening areas having the same value, any one or any two of them are selected. The selected opening areas correspond to those of the two pixels Aa and Ab having smaller opening areas.

Finally, in Step S4, a disposing operation is performed for disposing the two pixels Aa and Ab having smaller opening areas selected in Step S3 apart from each other so that the pixels Aa and Ab are not adjacent to each other.

By performing Step S4, the pixels other than the pixels Aa and Ab are disposed between the pixels Aa and Ab.

By this, in the design of the display device 1 shown in FIG. 1, the disposition of the pixels (sub-pixels) formed by the colored areas (R), (G), (B), and (C) having different opening areas is determined. Therefore, according to the method of disposing pixels according to the embodiment, it is possible to design and manufacture the display device which can display a white color with high precision and which can prevent vertical black lines from being perceived to display a high-quality color image.

In the method of disposing pixels according to the embodiment, an example of calculating the disposition of pixels by simulation with, for example, a computer is given. However, it is possible to determine the disposition of the pixels as illustrated in FIG. 2 by actually performing trial production of display devices in respective states and measuring color characteristics of the respective display devices.

Second Embodiment

Figure 4:
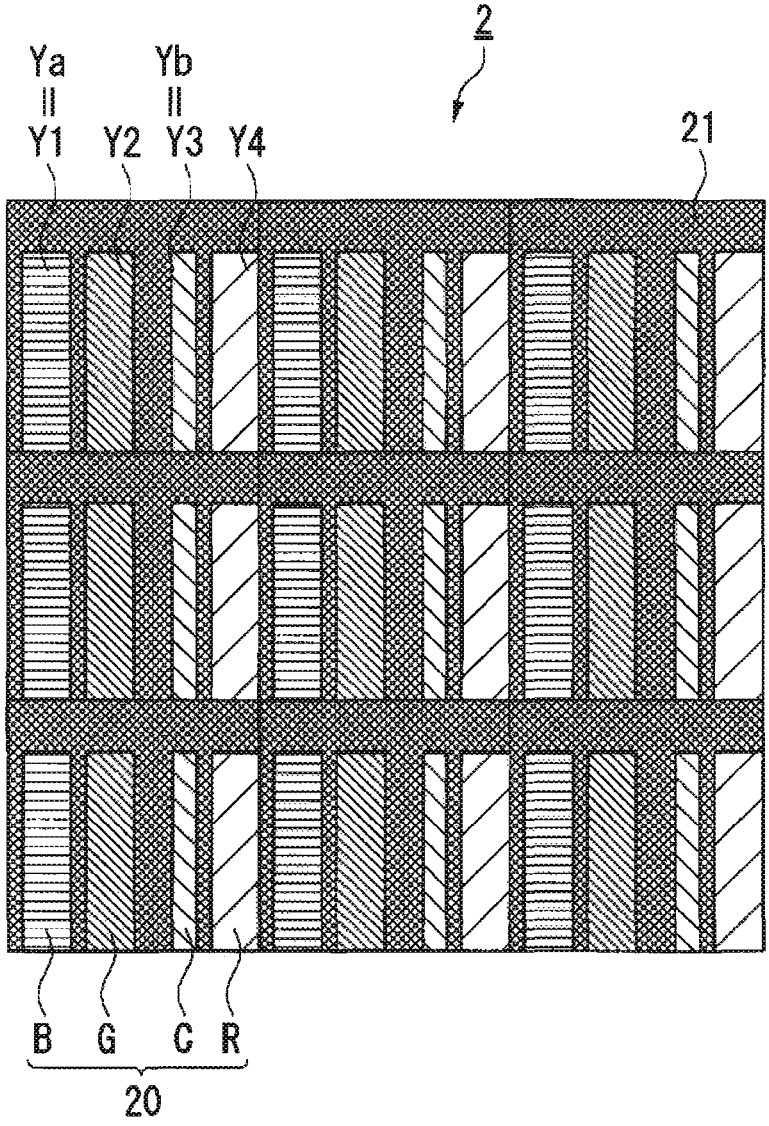
FIG. 4 is a plan view of a main portion of a display device according to a second embodiment of the invention.

FIG. 4 is a plan view of a main portion of a display device according to a second embodiment of the invention. That is, FIG. 4 shows a plane configuration of pixels in a display device 2 according to the second embodiment. Similarly to the display device 1 according to the first embodiment, the display device 2 performs a color displaying operation by synthesizing four colors. The four colors, (R), (G), (B), and (C), are the same as those used in the first embodiment. However, the display device 2 according to the second embodiment differs from the display device 1 according to the first embodiment in that, for example, two pixels Ya and Yb having smaller luminances are selected from the pixels of the four colors and the pixels Ya and Yb having smaller luminances are disposed apart from each other.

More specifically, in the display device 2, four pixels (sub-pixels), an (R) pixel, a (G) pixel, a (B) pixel, and a (C) pixel, are defined as one pixel set 20, and a plurality of such pixel sets 20 are regularly disposed vertically and horizontally. The display device 2 is a stripe display device in which a plurality of such pixel sets 20 are disposed on horizontal straight lines and in which the pixels are disposed on vertical straight lines so that that the pixels of the same color are disposed consecutively in straight lines vertically. A black matrix 21 is disposed as a light-shielding portion around the four pixels (sub-pixels).

In the display device 2, the areas (opening areas) of the four pixels (sub-pixels), that is, the (R) pixel, the (G) pixel, the (B) pixel, and the (C) pixel, which define one pixel set 20, are set so that, when they all perform a displaying operation (emit light), and a desired white light is produced. Here, "desired white light" refers to, for example, a color that is set on a black body locus in a chromaticity characteristic. In FIG. 4, the opening areas of the (B) pixel and the (G) pixel are substantially the same, and the opening area of the (C) pixel is smaller than the opening areas of the (B) pixel and the (G) pixel. Since the opening areas of the four pixels (sub-pixels) are set as mentioned above, it is possible for the one pixel set 20 to display a desired white color, so that the entire display device 2 can display the desired white color. The aforementioned relationships between the magnitudes of the opening areas are only examples. The opening areas only need to have magnitude relationships that allow one pixel set 20 to display the desired white color.

Comparing luminances Y1, Y2, Y3, and Y4 of the (B), (G), (C), and (R) pixels (sub-pixels) whose opening areas are set as mentioned above, since the opening area of the (C) pixel is smaller than those of the other pixels, the luminance Y3 of the (C) pixel is the smallest. The opening areas of the (B), (G), and (R) pixels (sub-pixels) are substantially the same. However, the luminance of the (B) pixel is small in terms of its color, so that the luminance Y1 of the (B) pixel is the second smallest. Among the pixels of the four colors, the (B) pixel and the (C) pixel are selected as two pixels Ya and Yb having the smaller luminances, and the pixels Ya and Yb having the smaller luminances are disposed apart from each other so as not to be adjacent to each other. The relationships between the magnitudes of the luminances of the pixels other than the two pixels Ya and Yb having the smaller luminances, that is, those between the magnitudes of the luminances of the (G) and (R) pixels need not be particularly considered. Therefore, the (G) and (R) pixels may be disposed anywhere on the assumption that the aforementioned conditions are satisfied.

Here, the pixels Ya and Yb having the smaller luminances are disposed apart from each other because, when these pixels Ya and Yb are not disposed close to each other, it is possible to reduce black vertical lines in the display device 2.

Accordingly, the display device 2 of the embodiment can reduce vertical black lines, which is one factor that determines image quality, by disposing the pixels (sub-pixels) of one pixel set 20 as a result of fully considering the pattern formed by the black matrix 21 and the luminances Y1, Y2, Y3, and Y4 of the corresponding pixels (sub-pixels). Therefore, the display device 2 according to the embodiment can enlarge the color range that it can reproduce by using four colors. In addition, the display device 2 can allow the pixels (sub-pixels) having different areas to display a desired white color with high precision, and can display a high-quality image without perceptible black lines. In addition, in general, the lower the resolving power of the display device with respect to vertical black lines, an observer tends to perceive them as large black lines. Therefore, the effect of reducing black lines becomes noticeable, the lower the resolving power of the display device 2.

Method of Disposing Pixels According to the Second Embodiment

Figure 5:
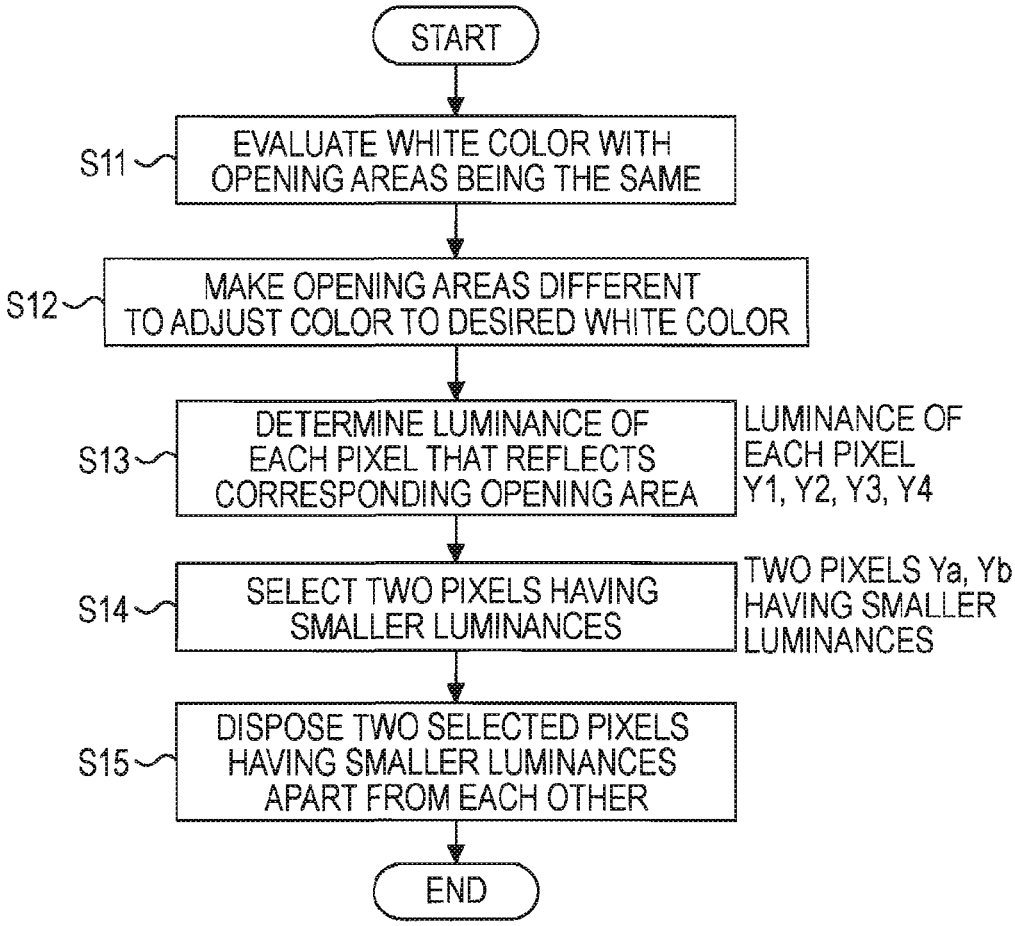
FIG. 5 is a flowchart of a method of disposing pixels according to the second embodiment of the invention.

FIG. 5 is a flowchart of a method of disposing pixels according to the second embodiment of the invention. That is, FIG. 5 is a flowchart illustrating the steps used when designing the display device 2 shown in FIG. 4. Therefore, this flowchart shows the steps that determine the disposition of the one pixel set 20 of pixels (sub-pixels) formed by the colored areas (R), (G), (B), and (C) when the opening areas of the pixels (sub-pixels) differ from each other.

First, in Step S11, a white-color evaluation operation is performed for evaluating a white color in terms of synthesized light for the four pixels (sub-pixels) having the same opening area.

The white color evaluation operation can be executed in the same way as the specific method of Step S1 according to the first embodiment.

Next, in Step S12, a white color adjustment operation is performed. In the white color adjustment operation, the opening areas of the pixels (sub-pixels) are made different on the basis of a white color evaluation result in Step S11, and opening areas (A1, A2, A3, and A4) of the pixels when the synthesized light for the pixels (sub-pixels) having different opening areas becomes a desired white color are determined.

Step S12 can be executed in the same way as the specific method of Step S2 according to the first embodiment.

Next, in Step S13, the luminances Y1, Y2, Y3, and Y4 of the four respective pixels (sub-pixels) that reflect the opening areas determined in Step S12 are determined.

The determination of the luminances in Step S13 can be executed by calculation, such as an integration operation.

Next, in Step S14, a selection operation is performed for selecting, from among the four pixels whose luminances have been determined in Step S13, the two pixels Ya and Yb having the smaller luminances.

Figure 6:
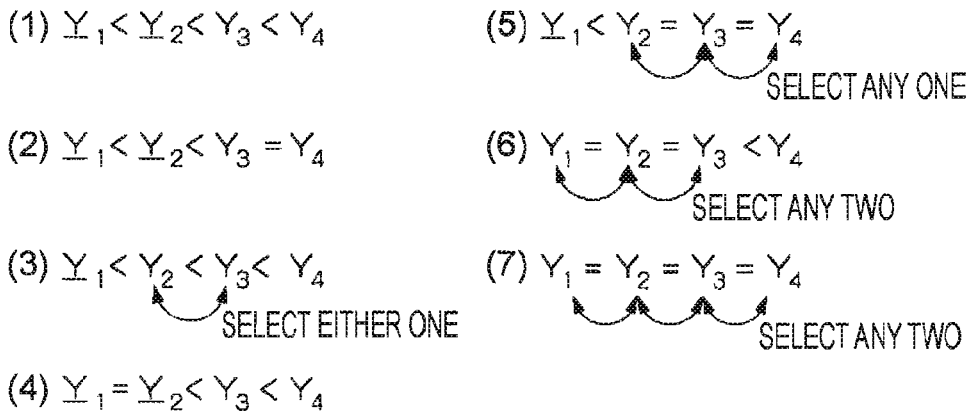
FIG. 6 illustrates a method of selecting two pixels having smaller luminances in the method of disposing pixels.

FIG. 6 shows the choices that are provided when selecting the two pixels Ya and Yb having the smaller luminances among the four pixels (sub-pixels) having the respective luminances Y1, Y2, Y3, and Y4. That is, FIG. 6 shows the seven choices that can be thought of as combinations of the luminances of the pixels (sub-pixels) having different magnitude relationships. In FIG. 6, the underlined luminances are selected as those having smaller values. For example, when there are a plurality of luminances having the same value, any one or any two of them can be selected. The selected luminances correspond to those of the two pixels Ya and Yb having the smaller luminances.

Finally, in Step S15, a disposing operation is performed for disposing the two pixels Ya and Yb, selected in Step S14, having the smaller luminances, apart from each other so that the pixels Ya and Yb are not adjacent to each other.

By performing Step S15, the pixels other than the pixels Ya and Yb are disposed between the pixels Ya and Yb.

By this, in the design of the display device 2 shown in FIG. 4, the disposition of the (R), (G), (B), and (C) pixels (sub-pixels) having different opening areas is determined as a result of considering the luminances of the pixels (sub-pixels). Therefore, according to the method of disposing pixels according to the embodiment, it is possible to design and manufacture the display device 2 which can display a white color with high precision, and which can prevent vertical black lines from being perceived to display a high-quality color image.

In the method of disposing pixels according to the embodiment, an example of calculating the disposition of pixels by simulation with, for example, a computer is given. However, it is possible to determine the disposition of the pixels as illustrated in FIG. 5 by actually performing trial production of display devices in respective states and measuring color characteristics of the respective display devices.

Application

Figure 7:
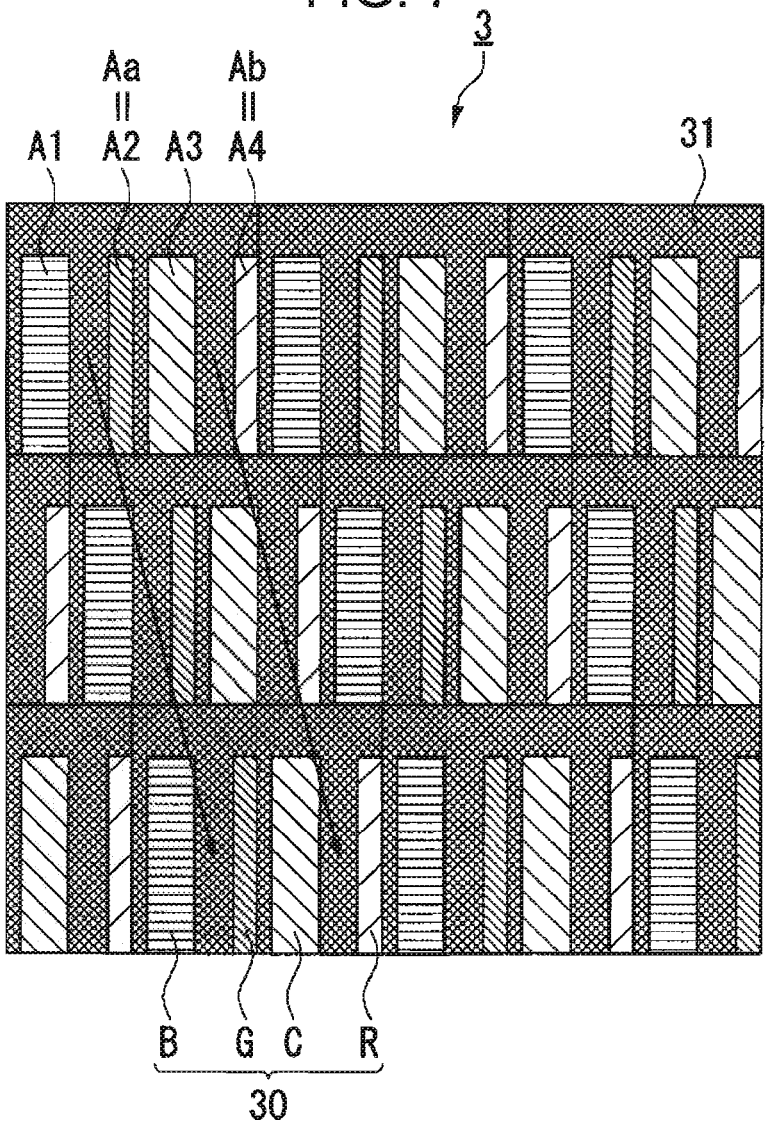
FIG. 7 is a plan view of a main portion of a display device according to an application of the invention.

FIG. 7 is a plan view of an application of the display device according to the first embodiment. The display device 1 according to the first embodiment is a stripe display device in which pixels of the same color are lined up vertically, whereas a display device 3 according to the application is a mosaic display device in which pixels of the same color are displaced vertically. Four colors, (R), (G), (B), and (C), mentioned below can be similarly used as in the first embodiment.

In the display device 3 shown in FIG. 7, four pixels, that is, an (R) pixel, a (G) pixel, a (B) pixel, and a (C) pixel, are defined as one pixel set 30, and a plurality of such pixel sets 30 are regularly disposed horizontally and vertically. The display device 3 is a mosaic display device in which the plurality of pixel sets 30 are disposed on horizontal straight lines and the pixels are vertically disposed so that a certain pixel of one color that is disposed one line below another pixel of the same color is displaced towards the right by an amount corresponding to one color. A black matrix 31 is disposed as a light-shielding portion around the four pixels, the (R) pixel, the (C) pixel, the (B) pixel, and the (C) pixel.

As with pixels (sub-pixels) of one pixel set 10 in the display device 1 shown in FIG. 1, the R, G, B, and C pixels (sub-pixels) of one pixel set 30 in the display device 3 are disposed so that pixels Aa and Ab having smaller opening areas are disposed apart from each other, that is, are disposed so that they are not adjacent to each other.

According to this application, the problem of perception of black vertical lines, which is one factor in determining image quality, can be mitigated in the mosaic display device, so that a display device providing high image quality can be realized. That is, the display device 3 according to the application, which is a mosaic display device in which a vertical line pattern is inherently less noticeable as compared to a stripe display device, can display a color image of even higher quality than a related mosaic display device.

Figure 8:
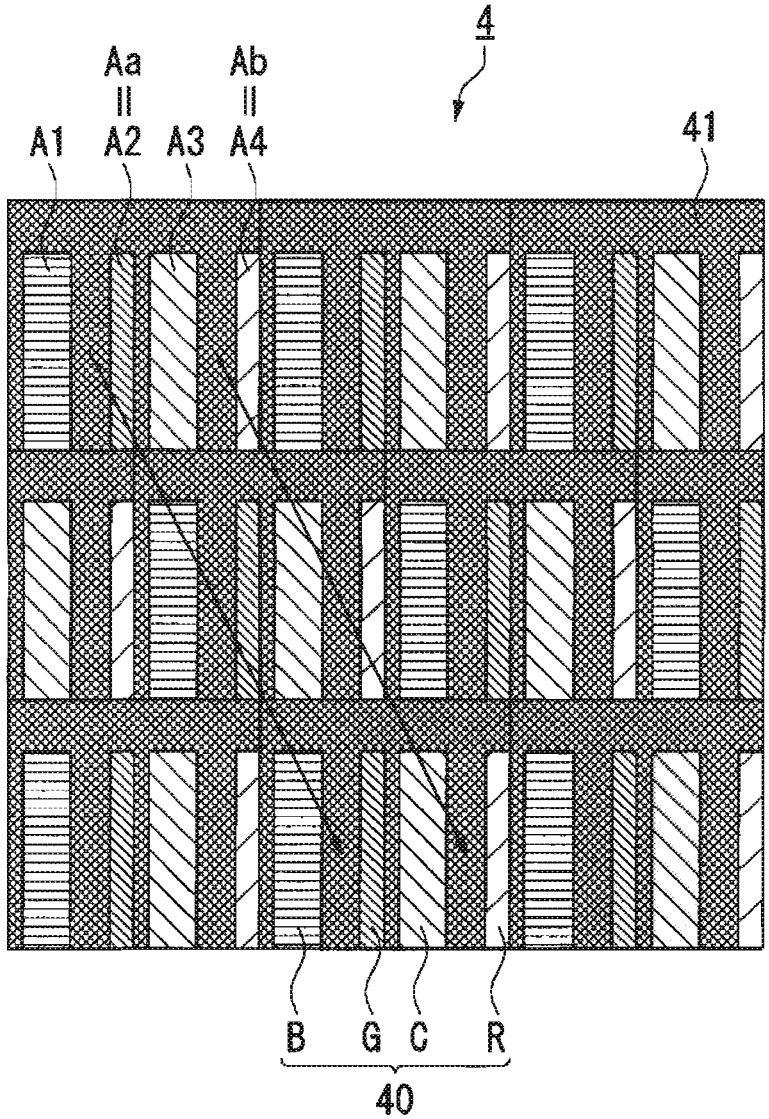
FIG. 8 is a plan view of a main portion of a display device according to another application of the invention.

FIG. 8 is a plan view of another application of the display device according to the first embodiment. Like the display device 3 shown in FIG. 7, a display device 4 according to this application is a mosaic display device to which the display device according to the first embodiment is applied. The display device 4 according to this application differs from the display device 3 in that a certain pixel of one color that is disposed one line below another pixel of the same color is displaced towards the right by an amount corresponding to two colors. Four colors, (R), (G), (B), and (C), mentioned below can be similarly used as in the first embodiment. The other structural features and advantages of the display device 4 are the same as those of the display device 3.

In the display device 4 shown in FIG. 8, four pixels, that is, an (R) pixel, a (G) pixel, a (B) pixel, and a (C) pixel, are defined as one pixel set 40, and a plurality of such pixel sets 40 are regularly disposed horizontally and vertically. The display device 4 is a mosaic display device in which the plurality of pixel sets 40 are disposed on horizontal straight lines and the pixels are vertically disposed so that a certain pixel of one color that is disposed one line below another pixel of the same color is displaced towards the right by an amount corresponding to two colors. A black matrix 41 is disposed as a light-shielding portion around the four pixels, the (R) pixel, the (G) pixel, the (B) pixel, and the (C) pixel.

As with pixels (sub-pixels) of one pixel set 10 in the display device 1 shown in FIG. 1, the R, G, B, and C pixels (sub-pixels) of one pixel set 40 in the display device 4 are disposed so that pixels Aa and Ab having smaller opening areas are disposed apart from each other, that is, are disposed so that they are not adjacent to each other.

According to this application, the problem of perception of black vertical lines, which is one factor in determining image quality, can be mitigated in the mosaic display device, so that a display device providing high image quality can be realized. That is, the display device 4 according to the application, which is a mosaic display device in which a vertical line pattern is inherently less noticeable as compared to a stripe display device, can display a color image of even higher quality than a related mosaic display device.

Advantages of the Invention

Next, the advantages of the display devices according to the embodiments of the invention will be given while referring to examples of display devices to which the invention is not applied.

Figure 9:
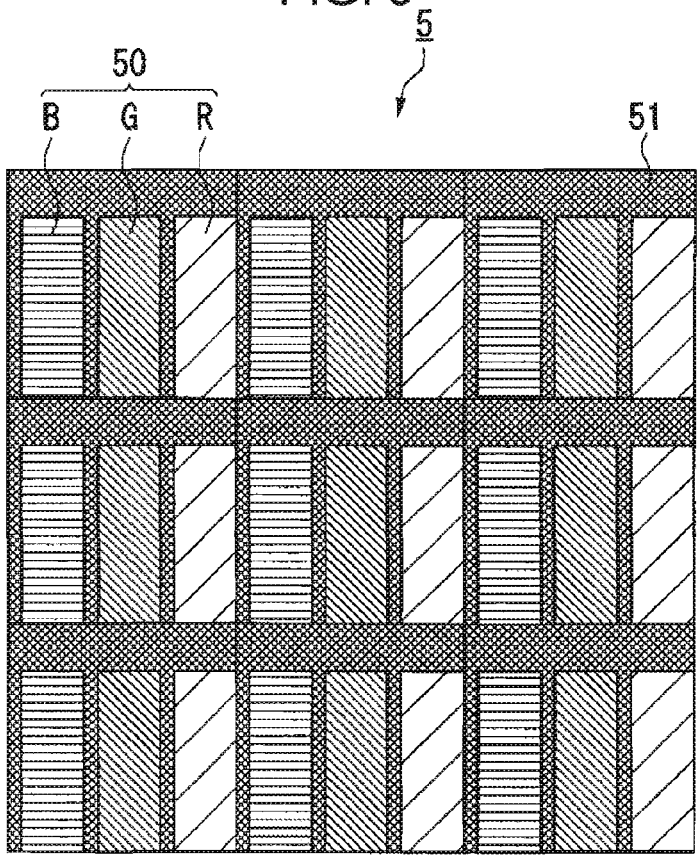
FIG. 9 is a plan view of one type of display device using three primary colors.

FIG. 9 is a plan view of a main portion of a display device 5 in which red (R), green (G), and blue (B) are defined as three primary colors. The display device 5 is a stripe display device to which the invention is not applied. One pixel set 50 comprises a red (R) pixel, a green (G) pixel, and a blue (B) pixel. A black matrix (light-shielding portion) 51 is disposed around the three pixels, the (R) pixel, the (G) pixel, and the blue (B) pixel.

Figure 10:
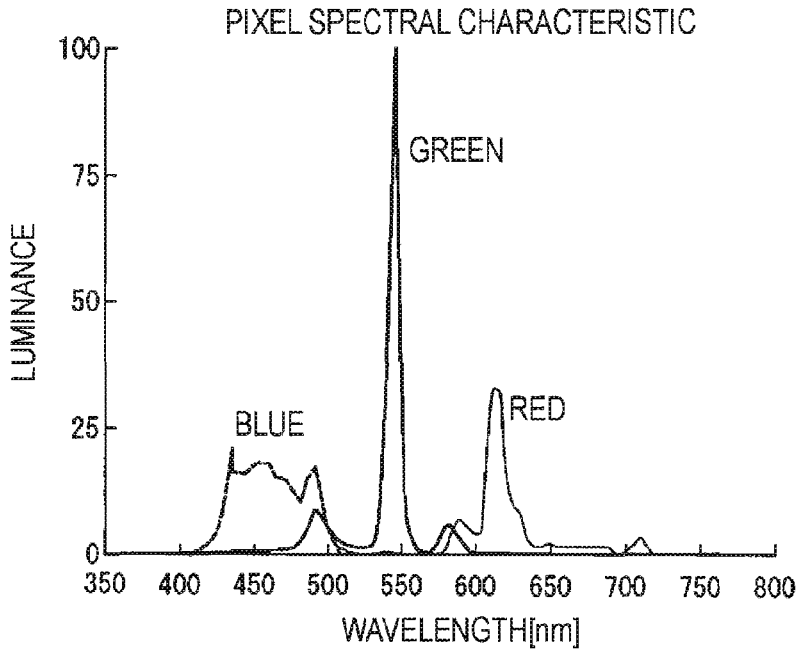
FIG. 10 is a graph of emission spectrum characteristics of the one type of display device.
Figure 11:
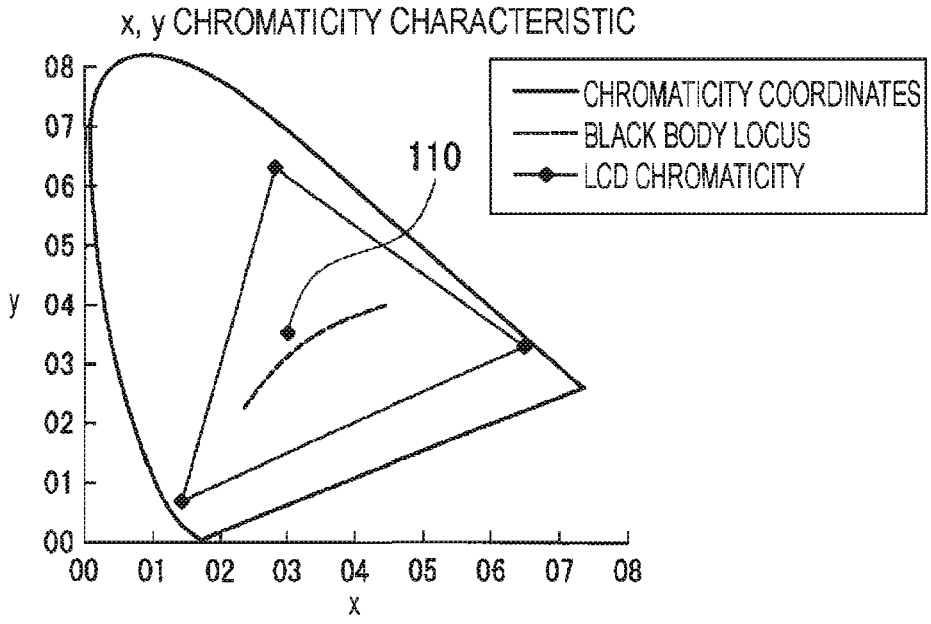
FIG. 11 is a chromaticity diagram of chromaticity characteristics of the one type of display device.

FIG. 10 is a graph of emission spectrum characteristics of the three pixels, the (R) pixel, the (G) pixel, and the (B) pixel, in the display device 5. In FIG. 10, the horizontal axis represents the wavelength and the vertical axis represents relative luminance when the maximum value is 100. FIG. 11 is a chromaticity diagram of chromaticity characteristics that can be displayed by the display device 5 (for example, an LCD). The inside of the triangle in FIG. 11 indicates the chromaticity characteristics based on the colors, that is, the three primary colors of the pixels R, G, and B, that can be displayed by the display device 5. The curve in the triangle shown in FIG. 11 represents a blackbody locus.

As shown in FIG. 9, in the display device 5, the opening areas of the pixels R, G, and B are equal to each other. The white color that is displayed by the display device 5 is represented by a dot 110 situated above the blackbody locus in the chromaticity characteristics shown in FIG. 11. In general, since a desired white color is often set on the blackbody locus, the white color displayed by the display device 5 is a greenish white color compared to the desired white color. In the chromaticity diagram, the higher the position of the dot 110 the more greenish the white color becomes.

Figure 12:
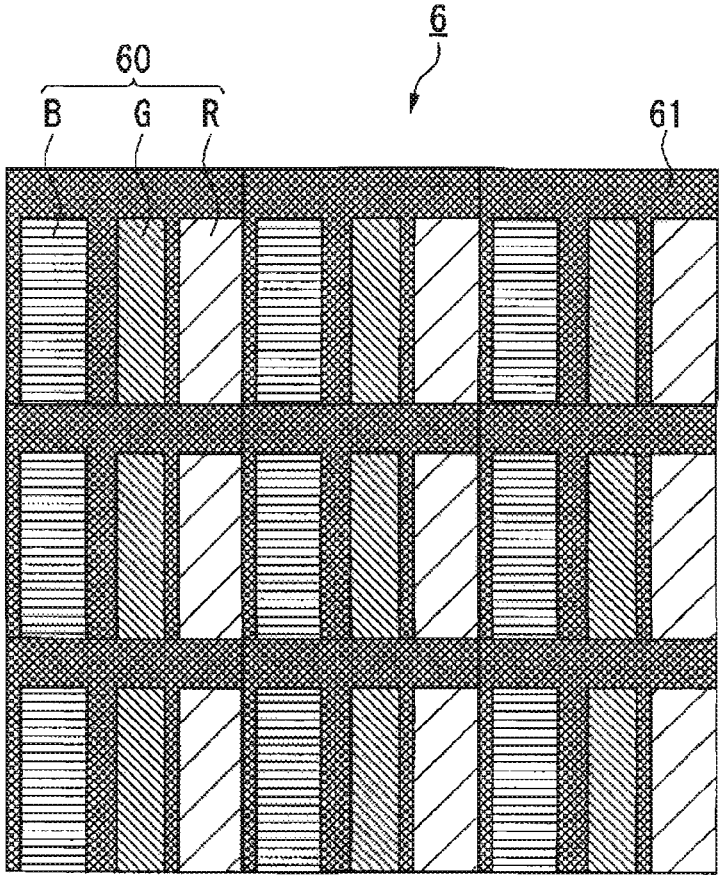
FIG. 12 is a plan view of another type of display device using three primary colors.

FIG. 12 is a plan view of a main portion of a display device 6 in which red (R), green (G), and blue (B) are defined as three primary colors. The display device 6 is a stripe display device to which the invention is not applied. The display device 6 differs from the display device 5 in that the opening areas of respective pixels R, G, and B of the three primary colors are not the same.

More specifically, in the display device 6, three pixels R, G, and B are defined as one pixel set 60 and the opening area of the pixel G is smaller than the opening areas of the pixels R and B. A black matrix 61 is disposed around the three pixels R, G, and B.

Figure 13:
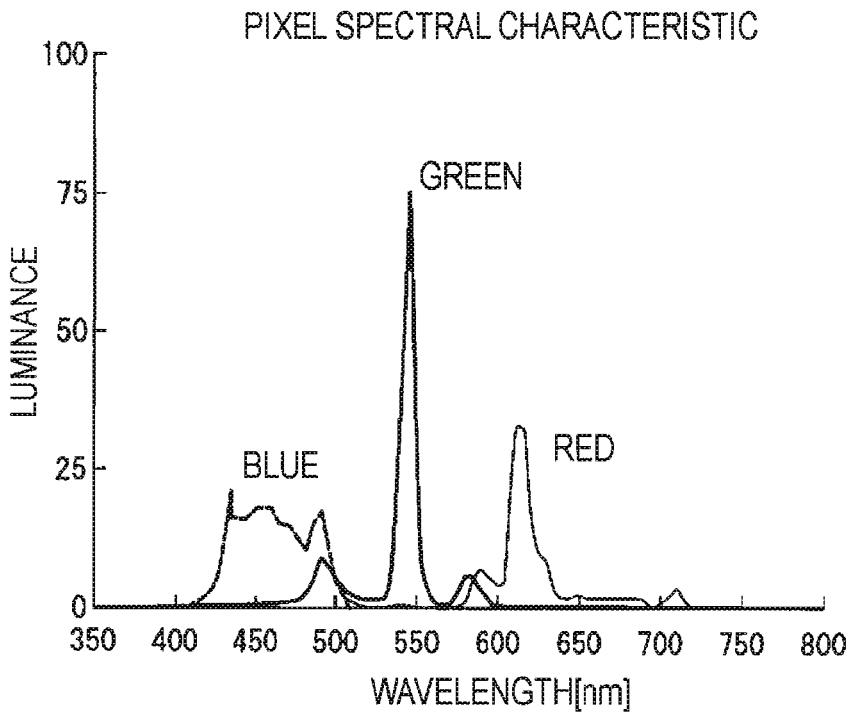
FIG. 13 is a graph of emission spectrum characteristics of the another type of display device.
Figure 14:
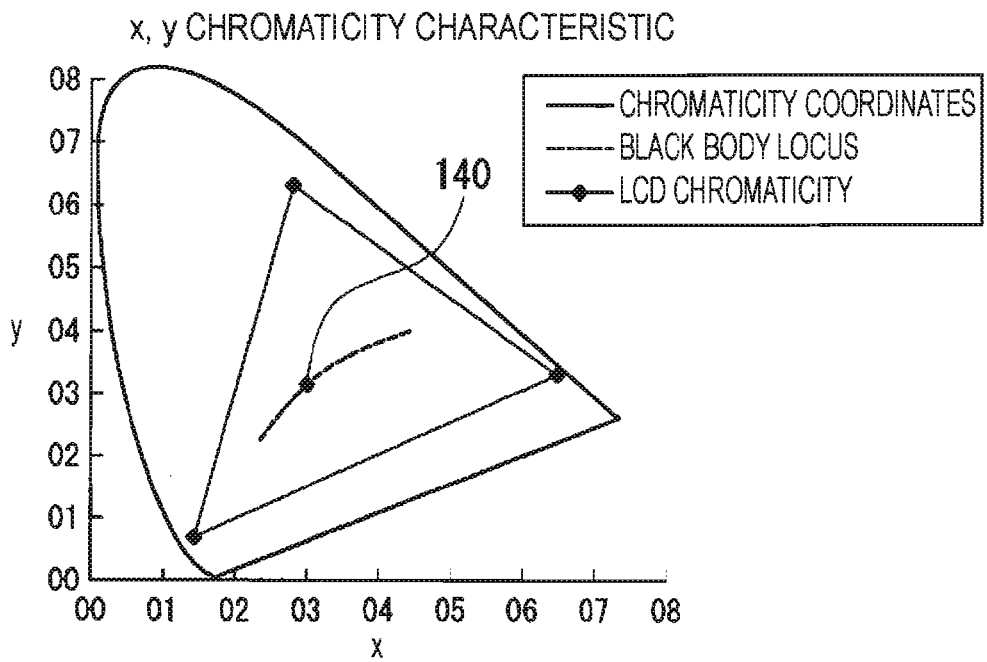
FIG. 14 is a chromaticity diagram of chromaticity characteristics of the another type of display device.

FIG. 13 is a graph of emission spectrum characteristics of the three pixels, the pixel R, the pixel G, and the pixel B, in the display device 6. In FIG. 13, the horizontal axis represents the wavelength and the vertical axis represents relative luminance when the maximum value is 100. FIG. 14 is a chromaticity diagram of chromaticity characteristics that can be displayed by the display device 6 (for example, an LCD). The inside of the triangle in FIG. 14 indicates the chromaticity characteristics based on the colors, that is, the three primary colors of the pixels R, G, and B, that can be displayed by the display device 6. The curve in the triangle shown in FIG. 14 represents a blackbody locus.

Since the opening area of the pixel G in the display device 6 is smaller than the opening areas of the other pixels, a peak of green (G) in FIG. 13 is lower than the peak of green (G3) in FIG. 10. Therefore, as shown in FIG. 14, the white color that is displayed by the display device 6 is less greenish, and is located at a point 140 that is plotted on the blackbody locus. Accordingly, the display device 6 can display a desired white color as a result of making different the opening areas of the pixels R, G, and B of the three primary colors.

Next, the problems that arise when the technology of the display device 6 (technology that sets the opening areas of the pixels R, G, and B unequal to each other) is merely applied to a four-primary-color display device will be explained. The problems arise due to the disposition of the pixels.

Figure 15A:
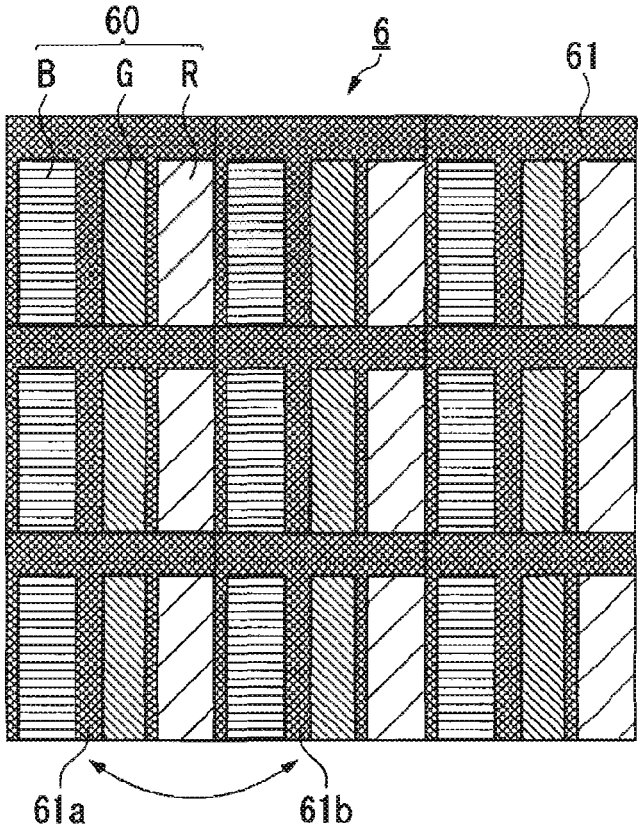
FIGS. 15A and 15B show structures having different dispositions of pixels in three-primary-color display devices.
Figure 15B:
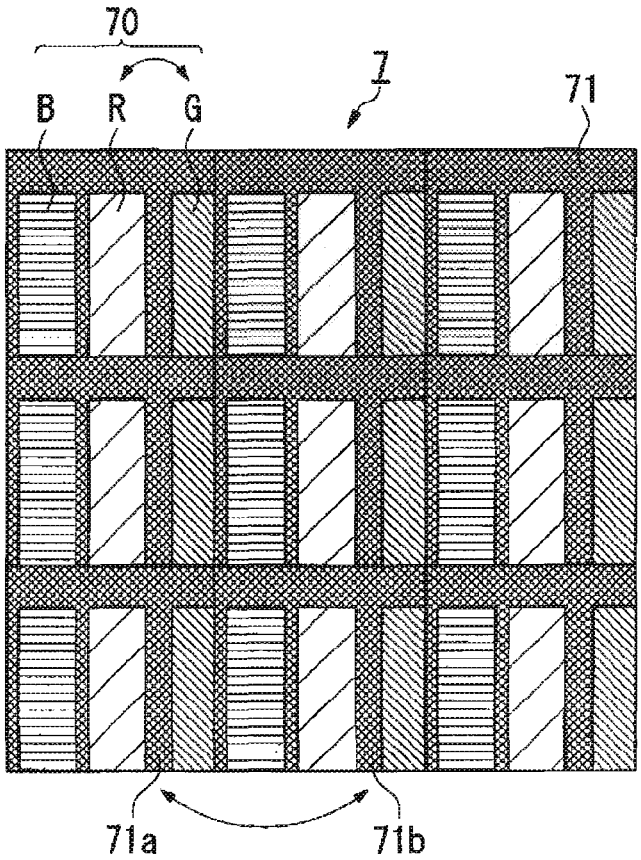

FIGS. 15A and 15B show structures having different dispositions of pixels in the display device 6 shown in FIG. 12, which is a three-primary-color display device. FIG. 15A is a plan view of the display device 6, and FIG. 15B is a plan view of a display device 7 in which the disposition of the pixels in the display device 6 is changed.

In the display device 6, one pixel set 60 comprises pixels B, G, and R that are disposed in that order from the left. In contrast, in the display device 7, one pixel set 70 comprises pixels B, R, and G that are disposed in that order from the left. In other words, the display device 7 differs from the display device 6 in that the pixels G and R are transposed. In each of the display devices 6 and 7, the opening area of the pixel G is smaller than the opening areas of the other pixels. Since the opening areas of the pixels G are smaller, the width of the black matrix 61 near the pixel G and the width of a black matrix 71 near the pixel G are increased. As a result, thick vertical black strips are seen near the pixels G.

Here, vertical strips (that is, thick black lines) 61*a* and 61*b* at the pixel G in the display device 6 and vertical strips (that is, thick black lines) 71*a* and 71*b* at the pixel G in the display device 7 will be focused on. Although the disposition of the pixels G and R in the display device 7 differs from that of the pixels G and R in the display device 6, the vertical strips 61*a* and 61*b* at the pixel G and the vertical strips 71*a* and 71*b* at the pixel G appear with every two pixels, as a result of which the intervals between the vertical strips in the display device 6 and those between the vertical strips in the display device 7 are equal to each other. In general, this similarly applies to the disposition of pixels in a three-primary-color display device other than the display devices 6 and 7. That is, in a three-primary-color display device, even if the pixels are disposed in any order and the opening areas are not equal to each other, a pattern produced by the pixels and the black matrix (interval between the thick vertical strips) does not change. This is because of the horizontal symmetry and the periodicity of the disposition of the pixels in a three-primary-color stripe display device.

Figure 16A:
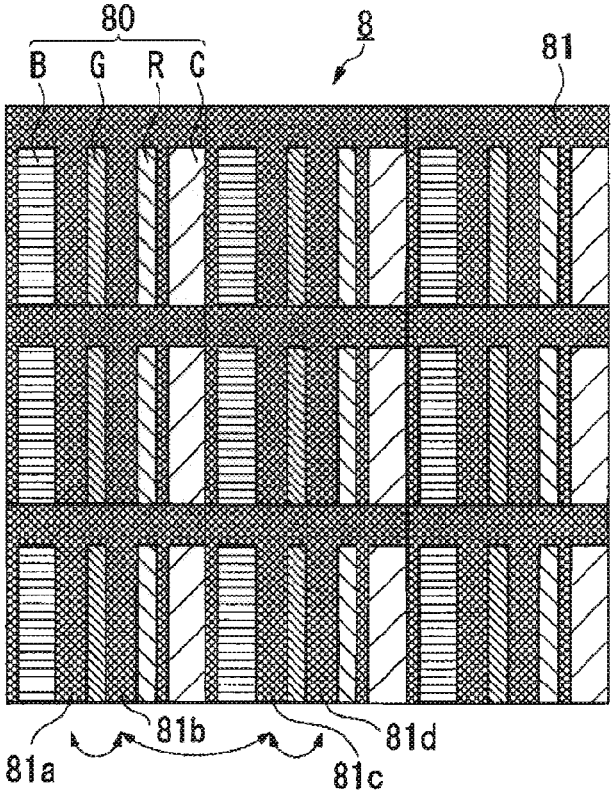
FIGS. 16A and 16B show structures having different dispositions of pixels in four-primary-color display devices.
Figure 16B:
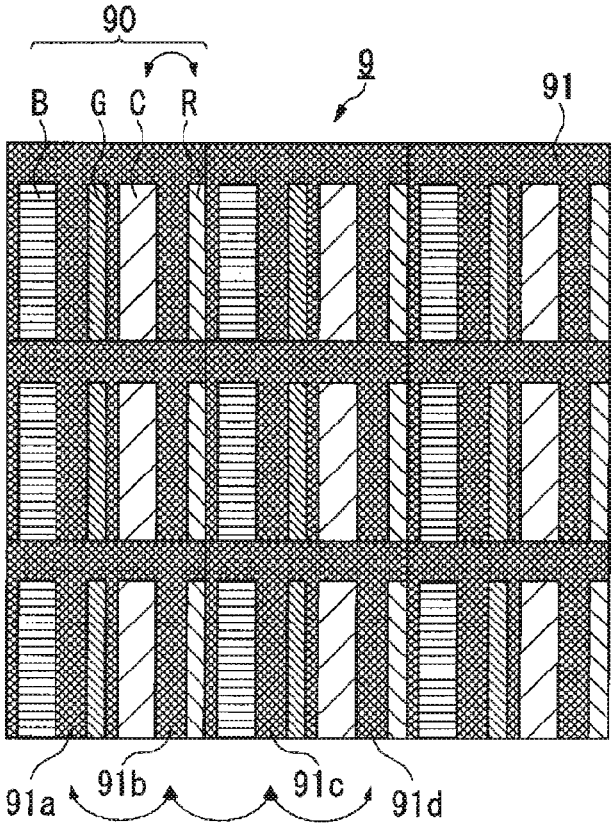

FIGS. 16A and 16B are plan views of a four-color display device. The disposition of pixels in a display device 8 shown in FIG. 16A and the disposition of pixels in a display device 9 shown in FIG. 16B differ from each other. More specifically, FIGS. 16A and 16B show a case in which, as a result of making unequal the opening areas of the pixels and changing the disposition of the pixels of four colors, a change in a pattern produced by the pixels and a black matrix (interval between thick vertical strips) occurs, thereby reducing image quality.

More specifically, in the display device 8, four pixels, that is, a (B) pixel, a (G) pixel, an (R) pixel, and a (C) pixel, making up one pixel set 80, are disposed in that order from the left. In contrast, in the display device 9, four pixels, that is, a (B) pixel, a (G) pixel, a (C) pixel, and an (R) pixel, making up one pixel set 90, are disposed in that order from the left. Accordingly, the display device 9 differs from the display device 8 in that the pixels R and C are transposed. In each of the display devices 8 and 9, the opening areas of the pixels G and R are smaller than the opening areas of the other pixels. That is, the width of a black matrix 81 near the pixels G and R and the width of a black matrix 91 near the pixels G and R are increased. As a result, vertical black strips 81*a*, 81*b*, 81*c*, 81*d*, 91*a*, 91*b*, 91*c*, and 91*d* are thick.

The intervals between the black vertical strips 81*a* and 81*b*, 81*b* and 81*c*, and 81*c* and 81*d* in the display device 8 and the intervals between the black vertical strips 91*a* and 91*b*, 91*b* and 91*c*, and 91*c* and 91*d* will be focused on. In the display device 8, as seen from the left, the black vertical strips 81*a* and 81*b* appear consecutively, followed the pixels C and B and then by the vertical black strips 81*c* and 81*d*. In contrast, in the display device 9, the black vertical strips 91*a*, 91*b*, 91*c*, and 91*d* appear with one pixel as seen from the left. In other words, a pattern that is produced by the black matrix and the pixels (interval between the thick vertical strips) in the display device 8 differs from a pattern that is produced by the black matrix and the pixels (interval between the thick vertical strips) in the display device 9. This is because a four-color stripe display device has an independent pixel disposition that is characteristic of the four-color stripe display device. The pixel disposition of B, G, R, and C in the display device 8 and the pixel disposition of B, G, C, and R in the display device 9 are independent dispositions even if their periodicities and horizontal symmetries are considered.

As in the display devices 8 and 9, a difference in a pattern that is produced by the black matrix and the pixels (interval between the black vertical strips) affects image quality. For example, when the black vertical strips 91*a* and 91*b* are close to each other as in the display device 8, the probability with which a viewer perceives these as a black vertical line is higher compared to the case in which the black vertical strips are disposed not close to each other as in the display device 9. Therefore, to realize a display device providing higher image quality, it is necessary to fully consider the pattern that is produced by the pixels and the black matrix.

In the display devices 1, 2, 3, and 4 according to the embodiments of the invention shown in FIGS. 1, 4, 7, and 8, respectively, the pattern that is produced by the black matrix and the pixels is fully considered and the pixels having the smaller areas or luminances among the four-color pixels are disposed apart from each other. Therefore, it is possible to realize a display device providing a high quality image in which black vertical lines are less easily perceived.

As mentioned above, when a liquid crystal display device having transmissive areas and reflective areas at sub-pixels is used, both the transmissive area and the reflective area may be used for the four-color colored areas in each embodiment. The four-color colored areas using the transmissive areas and the reflective areas are applied in the same way as the colors that are mentioned in the first embodiment.

Examples of the structures of the four-color colored areas include, in addition to the colored areas having a red hue, a blue hue, a green hue, and a cyan (blue-green) hue, colored areas having a red hue, a blue hue, a green hue, and a yellow hue, colored areas having a red hue, a blue hue, a deep-green hue, and a yellow hue, colored areas having a red hue, a blue hue, an emerald green hue, and a yellow-green hue, colored areas having a red hue, a blue hue, an emerald green hue, and a yellow hue, colored areas having a red hue, a blue hue, a deep green hue, and a yellow-green hue, and colored areas having a red hue, a blue-green hue, a deep green hue, and a yellow-green hue.

For a backlight of a liquid crystal device, an LED, a fluorescent tube, an organic electro-luminescence (EL) device may be used as a light source for each of the red light, green light, and blue light. Alternatively, a white light source may also be used. The white light source may be one that produces white light by a blue light emitter and a YAG fluorescent member. It is desirable for a light source for blue light to emit light having a wavelength peak of from 435 nm to 485 nm, a light source for green light to emit light having a wavelength peak of from 520 nm to 545 nm, and a light source for red light to emit light having a wavelength peak of from 610 nm to 650 nm. Properly selecting the display pixel on the basis of the wavelengths of the light sources for the red light, green light, and blue light makes it possible to provide good reproducibility of a wider range of colors and a white color.

In addition to the light sources for red light, green light, and blue light, a light source that emits light having a plurality of wavelength peaks at, for example, 450 nm and at 565 nm may be used.

Electronic Apparatuses

Electronic apparatuses comprising the display device of any one of the above-described embodiments will be described.

Figure 17A:
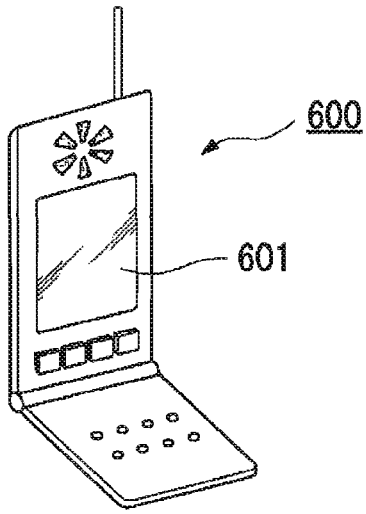
FIGS. 17A, 17B, and 17C are perspective views of electronic apparatuses according to embodiments of the invention.
Figure 17B:
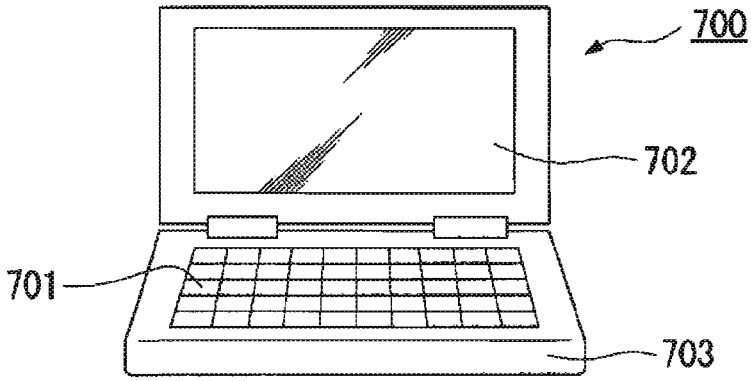
Figure 17C:
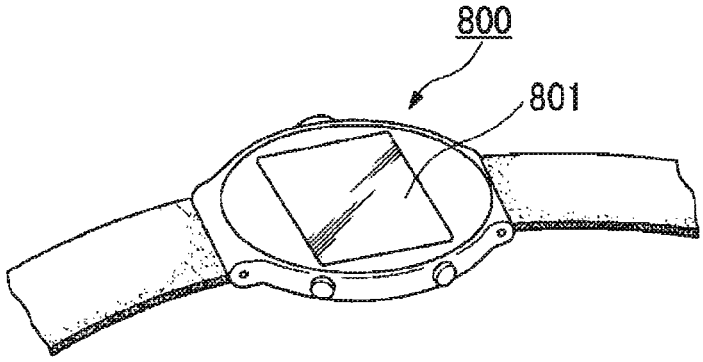

FIG. 17A is a perspective view of an example of a cellular phone. In FIG. 17A, reference numeral 600 denotes the body of the cellular phone and reference numeral 601 denotes a display unit comprising the display device of any one of the above-described embodiments. FIG. 17B is a perspective view of an example of a portable information processor such as a word processor or a personal computer. In FIG. 17B, reference numeral 700 denotes the information processor, reference numeral 701 denotes an input unit such as a keyboard, reference numeral 702 denotes a display unit comprising the display device of any one of the above-described embodiments, and reference numeral 703 denotes the body of the information processor. FIG. 17C is a perspective view of an example of a wristwatch electronic apparatus. In FIG. 17C, reference numeral 800 denotes the body of the watch, and reference numeral 801 denotes a display unit comprising the display device of any one of the above-described embodiments.

Since the electronic apparatuses shown in FIGS. 17A to 17C each comprise the display device of any one of the above-described embodiments, they can display a high-quality color image.

The technical scope of the invention is not limited to that of the above-described embodiments, so that various modifications may be made without departing from the scope of the gist of the invention. The specific materials, layer structures, etc., that are given in the embodiments are merely examples, so that various modifications may be made as appropriate.

The display device and the method of disposing pixels according to the invention may be applied to, for example, a color filter of a liquid crystal display device (LCD), a coloring layer or a color filter in an organic EL display device, a fluorescent member in a plasma display device (PDP), or a fluorescent member in a cathode ray tube display device (CRT). In addition, the display device and the method of disposing pixels according to the invention may be applied to any display device that produces colors by four-color dots (pixels).

In the invention, the method of setting the areas of the respective four pixels (sub-pixels) so as to display a desired white color may be replaced by a method of directly changing the luminous characteristics of a backlight or transmission characteristics of color filters of the respective pixels.

The method of disposing pixels according to the embodiment of the invention shown in FIG. 2 or FIG. 5 may be performed by using a program and a computer that executes the program. That is, the method of disposing pixels illustrated in FIG. 2 or 5 according to the invention may be performed as a result of setting the procedure illustrated in FIG. 2 or FIG. 5 in a program, recording the program on a computer readable recording medium, causing a computer system to read the program recorded on the recording medium, and executing the program. Here, the term "computer system" may refer to a computer system including hardware such as a peripheral device and an operating system (OS).

If a computer system makes use of a WWW system, the term "computer system" also refers to a computer system providing a homepage providing environment (or display environment). The term "computer readable recording medium" refers to a storage device including a portable medium, such as CD-ROM, ROM, a magneto-optical disc, or a flexible disc, or a hard disc built in the computer system.

In addition, the term "computer readable recording medium" refers to a recording medium that that holds a program for a certain period of time, such as a volatile memory (RAM) installed in the computer system serving as a client or a server to which the program is transmitted through a communication line, such as a phone line, or a network, such as the internet.

The program may be transmitted from the computer system which stores this program in, for example, a storage device to another computer system through a transmission medium or a transmitted wave in the transmission medium. Here, the transmission medium that transmits the program is a medium that transmits information, such as a network (communication network) including the Internet or a communication line including a telephone line.

The program may be one for executing some of the aforementioned functions. In addition, the program may be one that can execute the aforementioned functions as a result of being combined with a program that is already recorded in the computer system, that is, it may be a difference file (difference program).

The entire disclosure of Japanese Patent Application No. 2005-303725, filed Oct. 18, 2005 and 2006-123391, filed Apr. 27, 2006 are expressly incorporated by reference herein.

What is claimed is:

1. A display device comprising:

a first sub-pixel having a blue hue included in a visible light whose hue changes in accordance with wavelength;

a second sub-pixel having a red hue included in the visible light;

a third sub-pixel and a fourth sub-pixel having two types of hues included in the visible light, the two types of hues being selected from a hue range from a blue hue to a yellow hue;

pixels regularly arranged and each including the first to fourth sub-pixels; and a shielding layer, which is arranged at a periphery of the four sub-pixels, wherein at least two of the four sub-pixels have different areas, and two of the four sub-pixels having smaller areas among the four sub-pixels are arranged so as not to be adjacent to each other, and the two of the four sub-pixels having smaller areas are sub-pixels having two different hues, wherein a width of the shielding layer disposed at one side of each of the two small sub-pixels being formed to be wider than a width of the shielding layer disposed at another side of each of the two small sub-pixels, and whereby the shielding layers with the wider widths are also arranged so as to not be adjacent to each other.

2. A display device comprising:

a first sub-pixel having a blue hue included in a visible light whose hue changes in accordance with wavelength;

a second sub-pixel having a red hue included in the visible light;

a third sub-pixel and a fourth sub-pixel having two types of hues included in the visible light, the two types of hues being selected from a hue range from a blue hue to a yellow hue;

pixels regularly arranged and each including the first to fourth sub-pixels; and a shielding layer, which is arranged at a periphery of the four sub-pixels, wherein at least two of the four sub-pixels have different luminances, and two of the four sub-pixels having smaller luminances among the four sub-pixels are arranged so as not to be adjacent to each other, and the two of the four sub-pixels having smaller luminances are sub-pixels having different hues, and wherein a width of the shielding layer disposed at one side of at least one of the two sub-pixels having smaller luminances being formed to be wider than a width of the shielding layer disposed at another side of the at least one of the two sub-pixels having smaller luminances.

3. The display device according to claim 1, wherein a peak of a wavelength of light passing through the first sub-pixel lies in a range of from 415 nm to 500 nm, a peak of a wavelength of light passing through the second sub-pixel is more than at least 600 nm, a peak of a wavelength of light passing through the third sub-pixel lies in a range of from 485 nm to 535 nm, and a peak of a wavelength of light passing through the fourth sub-pixel lies in a range of from 500 nm to 590 nm.

4. The display device according to claim 1, wherein the four sub-pixels are arranged as a line in one direction in each pixel, and the pixels are arranged as lines so that the sub-pixels of the same hue are consecutively disposed in a direction cross to the one direction.

5. The display device according to claim 1, which is a mosaic type display device in which the pixels are arranged as lines extending in one direction so that the pixels that are next to each other in a direction that crosses to the one direction are displaced by at least an amount corresponding to one sub-pixel.

6. The display device according to claim 1, which is any one of a liquid crystal display device, an organic electroluminescence display device, a plasma display device, and a cathode-ray tube display device.

7. A method of arranging pixels of a display device that performs a displaying operation in color by using as one set a first sub-pixel, a second sub-pixel, a third sub-pixel, and a fourth sub-pixel, the first sub-pixel having a blue hue included in a visible light whose hue changes in accordance with wavelength, the second sub-pixel having a red hue included in the visible light, and the third sub-pixel and the fourth sub-pixel having two types of hues included in the visible light, the two types of hues being selected from a hue range from a blue hue to a yellow hue, a shielding layer being arranged at a periphery of the four sub-pixels, the method comprising:

evaluating a color that is produced when areas of the four sub-pixels are made the same and displaying the four sub-pixels;

determining the areas of the respective four sub-pixels that produce a predetermined white color by changing the areas of the four sub-pixels;

selecting two sub-pixels having smaller areas from among the four sub-pixels whose areas have been determined and arranging the two selected sub-pixels so as not to be adjacent to each other, the two of the four sub-pixels having smaller areas are sub-pixels having two different hues, forming the shielding layer so that a width disposed at one side of each of the two small sub-pixels being to be wider than a width of the shielding layer disposed at another side of each of the two small sub-pixels, and arranging the shielding layers with the wider widths so as to not be adjacent to each other.

8. A method of arranging pixels of a display device that performs a displaying operation in color by using as one set a first sub-pixel, a second sub-pixel, a third sub-pixel, and a fourth sub-pixel, the first sub-pixel having a blue hue included in a visible light whose hue changes in accordance with wavelength, the second sub-pixel having a red hue included in the visible light, and the third sub-pixel and the fourth sub-pixel having two types of hues included in the visible light, the two types of hues being selected from a hue range from a blue hue to a yellow hue, a shielding layer being arranged at a periphery of the four sub-pixels the method comprising:

evaluating a color that is produced when areas of the four sub-pixels are made the same and displaying the four sub-pixels;

determining luminances of the four sub-pixels, selecting two sub-pixels having smaller luminances from among the four sub-pixels, and arranging the two selected sub-pixels so as not to be adjacent to each other, the two sub-pixels having smaller luminances are sub-pixels having different hues; and forming the shielding layer so that a width of the shielding layer disposed at one side of at least one of the two sub-pixels having smaller luminances is wider than a width of the shielding layer disposed at another side of the at least one of the two sub-pixels having smaller luminances.

9. The method of arranging pixels according to claim 7, wherein a peak of a wavelength of light passing through the first sub-pixel lies in a range of from 415 nm to 500 nm, a peak of a wavelength of light passing through the second sub-pixel is more than at least 600 nm, a peak of a wavelength of light passing through the third sub-pixel lies in a range of from 485 nm to 535 nm, and a peak of a wavelength of light passing through the fourth sub-pixel lies in a range of from 500 nm to 590 nm.

10. A display device comprising:

a first sub-pixel having a colored region with a blue hue in a visible light region;

a second sub-pixel having a colored region with a red hue in the visible light region in which the hue changes according to wavelength;

a third and a fourth sub-pixel having colored regions with two different types of hues selected from a hue range from a blue hue to a yellow hue in the visible light region in which hue changes according to wavelength;

a shielding layer, which is arranged at a periphery of the four sub-pixels; and a plurality of pixels including the first, second, third and fourth sub-pixels aligned in one direction, the pixels being regularly arranged vertically and horizontally;

the four sub-pixels including two sub-pixels with relatively large areas and two sub-pixels with relatively small areas;

a width of the shielding layer disposed at one side of each of the two small sub-pixels being formed to be wider than a width of the shielding layer disposed at another side of each of the two small sub-pixels; and the two sub-pixels with the relatively small areas among the four sub-pixels being arranged so as to not be adjacent to each other, whereby the shielding layers with the wider widths are also arranged so as to not be adjacent to each other.

11. The display device according to claim 1, wherein the third sub-pixel has a hue in a range from a blue hue to a green hue and the fourth sub-pixel has a hue in a range from a green hue to a yellow hue, and the second sub-pixel and the fourth sub-pixel have smaller areas among the four sub-pixels.

12. The display device according to claim 2, wherein at least three of the four sub-pixels have substantially the same area.

13. The display device according to claim 1, wherein a peak of a wavelength of light passing through one of the two of the four sub-pixels having smaller areas lies in a range from 500 nm to 590 nm.

14. The method according to claim 7, wherein a peak of a wavelength of light passing through one of the two of the four sub-pixels having smaller areas lies in a range from 500 nm to 590 nm.

15. The display device according to claim 1, wherein one of the two of the four sub-pixels having smaller areas is a colored area in which $0.257 \leq x$ and $0.450 \leq y$ by an x, y chromaticity diagram.

16. The method according to claim 7, wherein one of the two of the four sub-pixels having smaller areas is a colored area in which $0.257 \leq x$ and $0.450 \leq y$ by an x, y chromaticity diagram.

* * * * *